US005342454A

United States Patent [19]

Hayakawa et al.

[11] Patent Number: 5,342,454

[45] Date of Patent: Aug. 30, 1994

[54] METHOD OF PRODUCING GRAIN ORIENTED SILICON STEEL SHEET HAVING LOW IRON LOSS

[75] Inventors: Yasuyuki Hayakawa; Ujihiro Nishiike; Bunjiro Fukuda, all of Chiba; Masataka Yamada; Yoshiaki Iida, both of Kobe; Fumihiko Takeuchi; Michiro Komatsubara, both of Chiba, all of Japan

[73] Assignee: Kawasaki Steel Corporation, Japan

[21] Appl. No.: 931,682

[22] Filed: Aug. 18, 1992

[30] Foreign Application Priority Data

Aug. 20, 1991 [JP] Japan ..... 3-231054
Jun. 26, 1992 [JP] Japan ..... 4-191334

[51] Int. Cl.[5] ..... H01F 1/04
[52] U.S. Cl. ..... 148/113; 148/111
[58] Field of Search ..... 148/111, 113

[56] References Cited

U.S. PATENT DOCUMENTS 4,979,997 12/1990 Kobayashi et al. ..... 148/111

FOREIGN PATENT DOCUMENTS 0908856 2/1982 U.S.S.R. ..... 148/111

*Primary Examiner*—John P. Sheehan
*Attorney, Agent, or Firm*—Austin R. Miller

[57] ABSTRACT

A method of producing a grain oriented silicon steel sheet is adapted to lower the iron loss. A silicon steel slab, containing about 2.0 to 4.0 weight % of Si and an inhibitor-forming amount of S, or Se, or both, is hot rolled. After the hot rolled steel sheet is annealed when necessary, the steel sheet is cold rolled into a cold rolled steel sheet having a final thickness by performing cold rolling either one time or a plurality of times with intermediate annealing therebetween, the cold rolled steel sheet then being subjected to decarburization, coating of the surface of the steel sheet with an annealing separation agent mainly comprising MgO, secondary recrystallization annealing, and purification annealing. In the cold rolling step, an oxide layer exists on the surface of the steel sheet. Specifically, in the cold rolling step, rolling oil is supplied only at the entrance of the rolling mill used, and an oxide layer having a thickness of about 0.05 to 5 μm is generated. Or, an outer oxide layer of an oxide layer structure generated on the surface of the steel sheet after hot rolling or intermediate annealing, is removed, and an inner oxide layer of a thickness of about 0.05 to 5 μm is maintained on the surface, the resultant steel sheet then being subjected to cold rolling.

15 Claims, 1 Drawing Sheet

METHOD OF PRODUCING GRAIN ORIENTED SILICON STEEL SHEET HAVING LOW IRON LOSS

BACKGROUND OF THE INVENTION

1. Field of the Invention

The present invention relates to a method of producing a grain oriented silicon steel sheet having a particularly low iron loss, which can be advantageously used to form iron cores for transformers and other electrical equipment.

2. Description of the Related Art

Methods for lowering the iron loss of a grain oriented silicon steel sheet include the following: [1] increasing the silicon (Si ) content; [2] making fine secondary-recrystallized grains; [3] aligning the orientation of secondary recrystallization with <1 0 0>; [4] locally changing the deformation stress during cold rolling so as to improve the primary-recrystallized texture; and [5] reducing the impurity content.

Among these methods, method [1] (increasing the Si content) is not suitable for industrial production because such an increase greatly deteriorates the cold-rolling workability of the steel.

Various proposals have been made on method [2] (making fine secondary-recrystallized grains), particularly, on the art of designing cold rolling to achieve low iron loss. This art is in various forms, which are disclosed in various documents. One form utilizes the aging effect in which carbon (C) and nitrogen (N) are fixed by heat treatment in the dislocation previously introduced during cold rolling. Typical examples of this form include: adopting a temperature of 50° to 350° C. during rolling (Japanese Patent Publication No. 50-26493); achieving heat effect within a temperature range from 50° to 350° C. between cold rolling passes (Japanese Patent Publication Nos. 54-13846 and 56-3892); and adopting a combination of rapid cooling during hot-rolled steel sheet annealing and maintaining the steel sheet within a temperature range from 50° to 500° C. between passes. However, from the viewpoint of industrial production, these disclosed methods have many problems. For instance, cold rolling becomes difficult due to age hardening. Since the heat treatment process is added, the production efficiency is lowered. Further, after rolling, the surface roughness of the steel sheet greatly deteriorates, thereby making it impossible to improve magnetic properties significantly.

Aligning the secondary recrystallization orientation with <1 0 0> (method [3]) means increasing the magnetic flux density. At present, it is possible to carry out this method achieving a value approximately 97% of the theoretical value. Therefore, this method can be improved further only marginally, furthering iron-loss reduction only slightly.

Concerning method [4] (locally changing the deformation stress during cold rolling so as to improve the primary-recrystallized texture), Japanese Patent Laid-Open No. 54-71028 and Japanese Patent Publication No. 58-55211 disclose rolling with grooved rolls, and Japanese Patent Publication No. 58-33296 discloses cold rolling with dull rolls having a surface roughness of 0.20 to 2 μm. These methods, however, have unresolved problems. Since the life of rolls is very short, this hinders production. The surface roughness of the steel sheet is so greatly deteriorated that, even when final-pass rolling is effected with smooth-surface rolls, the steel sheet tends to have poor surface roughness, thus making it impossible to improve magnetic properties Sufficiently.

Reducing the impurity content (method [5]) serves only slightly the purpose of lowering the iron loss. Impurities other than the inhibitor-forming component, such as phosphorus (P) and oxygen (O), aggravate the hysteresis loss. In order to avoid this problem, the current practice includes reducing the content of P and O to not more than approximately 30 ppm. Even if the P and O content is reduced below this level, the iron loss can be lowered only by a small margin from the currently obtainable value.

SUMMARY OF THE INVENTION

An object of the present invention is to provide a method for providing a grain oriented silicon steel sheet with a low-iron-loss property in a manner advantageous to industrial production.

We have studied in detail cold rolling of a grain oriented silicon steel sheet. We have surprisingly found that, if oxides exist in a very thin layer on the surface of the steel sheet during cold rolling, it is possible to achieve a very good iron-loss property. The present invention has been made based on this novel finding.

According to the present invention, there is provided a method of producing a grain oriented silicon steel sheet having a low iron loss, comprising the steps of: hot rolling a silicon steel slab containing 2.0 to 4.0% by weight of Si, and an inhibitor-forming component of at least one element selected from the group consisting of S and Se, thereby obtaining a hot rolled steel sheet; after annealing, when necessary, the hot rolled steel sheet, cold rolling the hot rolled steel sheet, which may have been annealed, into a cold rolled steel sheet having a final thickness, the cold rolling comprising either cold rolling performed one time or cold rolling performed a plurality of times with intermediate annealing intervening therebetween; decarburizing the cold rolled steel sheet; and, after coating the surface of the decarburized cold rolled steel sheet with an annealing separation agent mainly comprising MgO, subjecting the resultant cold rolled steel sheet to secondary recrystallization annealing and then purification annealing, wherein the cold rolling is effected while an oxide layer exists on the surface of the steel sheet.

Here, in order to cause an oxide layer to exist on the surface of the steel sheet, either of the following meets the purpose without entailing any disadvantage:

(1) In the cold rolling step, rolling oil is supplied only at the entrance of the rolling mill, and an oxide layer of a thickness of 0.05 to 5 μm is generated.

(2) An outer oxide layer of an oxide layer structure generated on the surface of the steel sheet after the hot rolling or intermediate annealing, is removed, and an inner oxide layer of a thickness of 0.05 to 5 μm is maintained on the surface.

In practice, it is preferable to effect the cold rolling within a temperature range from 100° to 350° C., and/or adopt a cooling speed of not less than 20° C./sec within a temperature range from 800° to 100° C. in the annealing before the final cold rolling.

BRIEF DESCRIPTION OF THE DRAWING

The single drawing is a photomicrograph showing oxides in the vicinity of the surface of a steel sheet.

DETAILED DESCRIPTION OF THE INVENTION

Figure 1:
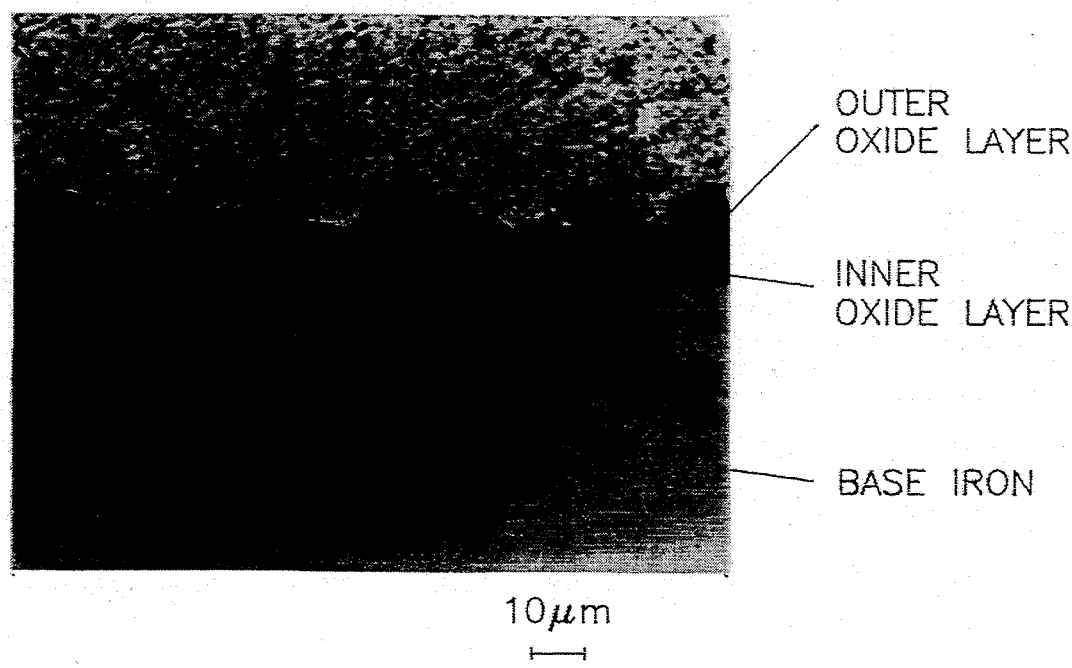

The method according to the present invention is applied to a silicon steel slab containing 2.0 to 4.0% by weight of Si (percentages by weight will hereinafter be abbreviated to "%"), and an inhibitor-forming component of at least one element selected from the group consisting of sulfur (S) and selenium (Se). A preferable chemical composition of the silicon steel slab may contain, in addition to Si contained in the above-stated range, carbon (C): 0.02 to 0.10%, manganese (Mn): 0.02 to 0.20%, and at least one element selected from the group consisting of S and Se: 0.010 to 0.040% (singly or in total). At least one of the following elements may additionally be present in the following amounts, as needed: aluminum (Al): 0.010 to 0.065%, nitrogen (N): 0.0010 to 0.0150%, antimony (Sb): 0.01 to 0.20%, copper (Cu): 0.02 to 0.20%, molybdenum (Mo): 0.01 to 0.05%, tin (Sn): 0.02 to 0.20 germanium (Ge): 0.01 to 0.30%, and nickel (Ni): 0.02 to 0.20%.

The following are preferable contents of various chemical components:

Si: about 2.0 to 4.0%

Si is important for increasing the electric resistance of the product as well as reducing its eddy current loss. If the Si content is less than 2.0%, the crystal orientation is damaged by $\alpha$-$\gamma$ transformation during the final finish annealing. If this content exceeds 4.0%, problems arise in the cold-rolling workability of the material. Therefore, Si content should preferably range from about 2.0 to 4.0%.

C: about 0.02 to 0.10%

If the C content is less than about 0.02%, it is not possible to obtain a good primary-recrystallized structure. If this content exceeds about 0.10%, this results in poor decarburization, thereby deteriorating magnetic properties. Therefore, the C content should preferably range from about 0.02 to 0.10%.

Mn: about 0.020 to 0.20%

Mn forms MnS and/or MnSe to act as a part of the inhibitor. If the Mn content is less than 0.02%, the function of the inhibitor is insufficient. If this content exceeds 0.20%, the slab heating temperature becomes too high to be practical. Therefore, the Mn content should preferably range from about 0.02 to 0.20%. S and/or Se: about 0.010 to 0.040%

Se and S are components for forming an inhibitor. If the content of one of S and Se, or if the total content of both of them is less than 0.010%, the function of the inhibitor is insufficient. If the S and/or Se content exceeds 0.040%, the slab heating temperature becomes too high to be practical. Therefore, the S and/or Se content should preferably range from about 0.010 to 0.040%.

Al: about 0.010 to 0.065%, N: about 0.0010 to 0.0150%

Components which may be additionally contained include AlN, a known inhibitor-forming component. In order to obtain a good iron-loss property, a minimum Al content of about 0.010% and a minimum N content of about 0.0010% are necessary. However, if the Al content exceeds about 0.065%, or if the N content exceeds about 0.0150%, AlN precipitates coarsely, and AlN loses its inhibiting ability. Therefore, the Al content and the N content should preferably be within the above-stated ranges.

Sb: about 0.01 to 0.20%, Cu: about 0.01 to 0.20%

Sb and Cu may be added to increase the magnetic flux density. If the Sb content exceeds about 0.20%, this results in poor decarburization, whereas if the content is less than about 0.01%, substantially no effect is obtained from such addition of Sb. Therefore, the Sb content should preferably range from about 0.01 to 0.20%. If the Cu content exceeds about 0.20%, the pickling ability is deteriorated, whereas if the content is less than about 0.01%, such Cu addition provides substantially no effect. Therefore, the Cu content should preferably range from about 0.01 to 0.20%.

Mo: about 0.01 to 0.05%

Mo may be added to improve the surface properties. If the Mo content exceeds about 0.05%, this results in poor decarburization, whereas if the content is less than about 0.01%, such Mo addition provides substantially no effect. Therefore, the Mo content preferably ranges from about 0.01 to 0.05%.

Sn: about 0.01 to 0.30%, Ge: about 0.01 to 0.30%, Ni: about 0.01 to 0.20%, P: about 0.01 to 0.30%, V: about 0.01 to 0.30%

Sn, Ge, Ni, P, and/or V may be added in order to further improve the iron-loss property. If the Sn content exceeds about 0.30%, the material becomes brittle, whereas if the content is less than about 0.01%, such Sn addition provides substantially no effect. Therefore, the Sn content should preferably range from about 0.01 to 0.30%. If the Ge content exceeds about 0.30%, it is not possible to obtain a good primary-recrystallized structure, whereas if the content is less than about 0.10%, such Ge addition provides substantially no effect. Therefore, the Ge content should preferably range from about 0.01 to 0.30%. If the Ni content exceeds about 0.20%, the hot-rolling strength of the material lowers, whereas if the content is less than about 0.01%, such Ni addition provides substantially no effect. Therefore, the Ni content should preferably range from about 0.01 to 0.20%. Similarly, if the P content exceeds about 0.30%, the hot-rolling strength of the material lowers, whereas if the content is less than about 0.01%, such P addition provides only small effect. Therefore, the P content should preferably range from about 0.01 to 0.30%. If the V content exceeds about 0.30%, this results in poor decarburization, whereas if the content is less than about 0.01%, such V addition provides only small effect. Therefore, the V content should preferably range from about 0.01 to 0.30%.

A silicon steel slab having a preferable chemical composition, such as above, can be prepared by subjecting a molten steel, obtained by a conventionally-used steel-producing method, to a casting process employing a continuous casting method or other steel casting method. The casting process may include blooming, when necessary.

The thus prepared slab is subjected to hot rolling, and, when necessary, the resultant hot rolled steel sheet is annealed. Thereafter, the hot rolled steel sheet, which may have been annealed, is subjected to either cold rolling performed one time or cold rolling performed a plurality of times with intermediate annealing therebetween, thereby obtaining a cold rolled steel sheet having a final thickness.

It is important that, in this cold rolling, there be a very thin and dense oxide layer on the surface of the steel sheet.

This is because when the steel sheet is cold rolled while oxides are positioned very thinly and densely on the surface of the steel sheet, it is possible to substantially lower the iron loss of the steel.

However, if the thickness of the oxide layer is less than about 0.05 μm, the layer may peel off the surface during cold rolling and fail to provide any advantageous effect. On the other hand, if the oxide layer thickness exceeds about 5 μm, the function of the inhibitor on the surface layer deteriorates, resulting in poor secondary recrystallization, and hence, poor magnetic properties. Therefore, an advantageous thickness of the oxide layer ranges from about 0.05 to 5 μm.

It is not thoroughly established what mechanism of cold rolling performed while oxides are very thinly present on the surface of the steel sheet improves the iron-loss property. However, we consider the mechanism may be the following:

When cold rolling is performed while oxides, existing densely on the surface of the steel sheet, are maintained, a tensile force is generated at the interface between the oxides and the base iron of the steel sheet, thereby causing a change in the slip system. As a result, (1 1 0) <0 0 1> grains increase in the texture of the surface layer where secondary-recrystallized grains are preferentially generated, whereby secondary-recrystallized grains are made fine. Accordingly, the iron-loss property of the steel sheet is improved.

Usually, oxides generated on the surface of the steel sheet after hot rolling or high-temperature intermediate annealing, are completely removed before cold rolling. This is because, if the oxides remain, they may scale off during cold rolling, and may cause defects in the final product.

In the present invention, such oxides may be completely removed before cold rolling. In this case, oxides are newly generated very thinly and densely in an initial stage of the cold rolling of the present invention. For this purpose, it is effective to generate oxides at a temperature at which no recrystallization occurs.

For instance, burner(s) are disposed at the entrance and/or the exit of each cold rolling pass so as to heat the steel sheet. This method is advantageous from the production viewpoint. It is also possible to heat coils for each pass so as to generate oxides of the above-described kind on the surface. Among such possible methods, cooling oil may be used in the cold rolling and supplied only at the entrance of each pass, with no cooling oil supplied at the exit. This is effective. Cooling oil for rolling is normally used at both the entrance and exit of the rolling mill. However, if cooling oil is used only at the entrance, this makes it possible to prevent reduction of steel sheet temperature after rolling. In this way, therefore, the steel sheet temperature increases to such an extent that some of the oil (rolling oil) burns on the surface of the steel sheet, causing oxides to be thinly generated on the surface.

In the case of a steel containing Si, the oxides generated on the surface of the steel sheet by hot rolling or intermediate annealing are in the form of an oxide layer structure, which comprises, as shown in FIG. 1, an outer oxide layer (mainly made of FeO and $Fe_2O_3$) in which oxidation proceeds as iron (Fe) diffuses outward, and an inner oxide layer (mainly made of $SiO_2$) which is below the outer oxide layer, and in which oxidation proceeds as O diffuses inward. Therefore, before the steel sheet is subjected to cold rolling, only the outer oxide layer may be removed while maintaining the inner oxide layer.

If both of the outer oxide layer and the inner oxide layer remain, this is disadvantageous in that the external appearance of the surface is deteriorated, and that the rolling rolls wear severely. In addition, the outer layer, which is not dense, may peel off during rolling. In such case, the inner oxide layer may also peel off together with the peeling outer oxide layer, making it impossible to achieve the above effect of improving the iron-loss property by utilizing oxides.

However, if the inner oxide layer has a thickness of less than about 0.05 μm, the layer may peel off from the surface during cold rolling, failing to provide any advantageous effect. If this thickness exceeds about 5 μm, the function of the inhibitor on the surface layer deteriorates, resulting in poor secondary recrystallization, and hence, poor magnetic properties. Therefore, an advantageous thickness of the inner oxide layer ranges from about 0.05 to 5 μm.

Where only the outer oxide layer is to be removed, methods which may be used for this purpose include: suitably controlling pickling conditions, mechanically cutting the relevant surface layer; and peeling by causing a flow of water or a suitable substance to collide with the relevant surface layer.

The adoption of the above-described iron-loss property improving mechanism according to the present invention is advantageous in the following respects: Since the effect is different from that of aging treatment directed to fixing C and N in the dislocation, the adoption of that mechanism does not cause hardening of the material due to aging. Therefore, the rolling is easy, and the producibility is high. Further, the adoption of the mechanism is different from the art in which the deformation stress during cold rolling is locally changed with grooved or dull rolls so as to improve the primary-recrystallized texture. In contrast, according to the present invention, it is possible to roll with smooth-surface rolls. This makes it possible to keep the surface of the material smooth, which is very advantageous to the improvement of iron-loss property.

Of course, the effect of the iron-loss improving mechanism may be combined with the effect of aging having a different magnetic-property improving mechanism. Further, although the producibility is lower, the magnetic properties can be further improved by adopting a rolling temperature of about 100° to 350° C. If the rolling temperature is less than about 100° C., the resultant effect is insufficient, whereas if this temperature exceeds about 350° C., the magnetic flux density lowers conversely, thereby deteriorating the iron-loss property. Thus, the rolling temperature should preferably range from about 100° to 350° C.

It is also possible to adopt the iron-property improving mechanism in combination with a method in which the annealing before the final cold rolling employs a cooling speed of not less than about 20° C./sec within a temperature range from about 800° to 100° C., so that fine carbide particles precipitate to improve the cold-rolled texture. The cooling speed should preferably be about 20° C./sec or higher because, if the speed is lower, fine carbide particles do not precipitate, and the iron-loss property cannot be significantly improved.

After final cold rolling, the cold-rolled steel sheet is subjected to decarburization. Subsequently, an annealing separation agent mainly comprising MgO is coated on. Thereafter, final finish annealing is effected at a temperature substantially equal to 1200° C., and then coating is effected for the purpose of imparting a tensile force, thereby obtaining a final product.

The present invention will now be described by reference to examples, which are intended to be illustrative and not to define or to limit the scope of the invention, which is defined in the claims.

EXAMPLE 1

Slabs of a silicon steel containing 3.25% of Si, 0.041% of C, 0.069% of Mn, 0.021% of Se, and 0.025% of Sb, the balance essentially consisting of Fe and impurities, were prepared. The silicon steel slabs were heated at 1420° C. for 30 minutes, and then hot rolled into hot rolled steel sheets of a thickness of 2.0 mm. Subsequently, after the hot rolled steel sheets were annealed at 1000° C. for 1 minute, the annealed steel sheets were cold rolled.

Specifically, the steel sheets were first cold rolled to a thickness of 0.60 mm with a rolling mill while oxides were generated through various thicknesses, as shown in Table 1, on the respective surfaces of the steel sheets by heating the steel sheets by burners disposed at the entrance and the exit of the rolling mill. Then, the steel sheets were subjected to intermediate annealing at 950° C. for 2 minutes. The steel sheets were further cold rolled to a final thickness of 0.20 mm while oxides were generated by heating the steel sheets by similar burners.

Thereafter, the thus cold rolled steel sheets were subjected to decarburization annealing at 820° C. for 2 minutes, and, after MgO was coated on, the resultant steel sheets were subjected to finish annealing at 1200° C. for 5 hours. The products thus obtained had their magnetic characteristics (magnetic flux density and iron loss) measured. The results of this measurement are also shown in Table 1. As will be understood from Table 1, products obtained according to the present invention had remarkably low iron losses.

TABLE 1

| OXIDE THICKNESS (AVERAGE: μm) | MAGNETIC FLUX DENSITY $B_8$ (T) | IRON LOSS $W_{17/50}$ (w/kg) | REFERENCE |
|---|---|---|---|
| 0.1 | 1.905 | 0.814 | EXAMPLE OF THE INVENTION |
| 0.3 | 1.908 | 0.785 | EXAMPLE OF THE INVENTION |
| 0.7 | 1.908 | 0.800 | EXAMPLE OF THE INVENTION |
| 1.5 | 1.907 | 0.781 | EXAMPLE OF THE INVENTION |
| 3.0 | 1.907 | 0.798 | EXAMPLE OF THE INVENTION |
| 5.0 | 1.905 | 0.813 | EXAMPLE OF THE INVENTION |
| 0.03 | 1.905 | 0.848 | COMPARISON EXAMPLE |
| 10 | 1.883 | 0.894 | COMPARISON EXAMPLE |

EXAMPLE 2

Slabs of a silicon steel containing 3.39% of Si, 0.076% of C, 0.076% of Mn, 0.024% of Se, 0.022% of Al, 0.0093% of N, 0.12% of Cu, and 0.029% of Sb, the balance essentially consisting of Fe and impurities, were prepared. The silicon steel slabs were heated at 1430° C. for 30 minutes, and then hot rolled into hot rolled steel sheets of a thickness of 2.2 mm. Subsequently, after the hot rolled steel sheets were annealed at 1000° C. for 1 minute, the annealed steel sheets were cold rolled.

Specifically, the steel sheets were first cold rolled to a thickness of 1.5 mm while scales having various thicknesses, as shown in Table 2, were generated on the respective surfaces of the steel sheets by heating the steel sheets by burners disposed at the entrance and the exit of the rolling mill. Then, the steel sheets were subjected to intermediate annealing at 1100° C. for 2 minutes, the annealing constituting in this case annealing before final cold rolling. The steel sheets were further cold rolled to a final thickness of 0.23 mm while oxides were generated by heating the steel sheets by similar burners.

Thereafter, the thus cold rolled steel sheets were subjected to decarburization annealing at 820° C. for 2 minutes, and, after MgO was coated on, the resultant steel sheets were subjected to finish annealing at 1200° C. for 5 hours. The magnetic characteristics (magnetic flux density and iron loss) of the thus obtained products measured, the results of this measurement being also shown in Table 2. As will be understood from Table 2, products obtained according to the present invention had remarkably low iron losses.

TABLE 2

| OXIDE THICKNESS (AVERAGE μm) | COOLING SPEED (°C./s) *1 | COLD ROLLING TEMPERATURE (°C.) | MAGNETIC FLUX DENSITY $B_8$ (T) | IRON LOSS $W_{17/50}$ (w/kg) | REMARKS |
|---|---|---|---|---|---|
| 0.30 | 10 | 25 | 1.942 | 0.840 | EXAMPLE OF THE INVENTION |
| 0.30 | 30 | 25 | 1.939 | 0.828 | EXAMPLE OF THE INVENTION |
| 0.30 | 10 | 150 | 1.948 | 0.808 | EXAMPLE OF THE INVENTION |
| 0.30 | 30 | 150 | 1.940 | 0.808 | EXAMPLE OF THE INVENTION |
| 0.95 | 30 | 150 | 1.938 | 0.805 | EXAMPLE OF THE INVENTION |
| 0.03 | 30 | 25 | 1.934 | 0.928 | COMPARSION |

TABLE 2-continued

| OXIDE THICKNESS (AVERAGE μm) | COOLING SPEED (°C./s) *1 | COLD ROLLING TEMPERATURE (°C.) | MAGNETIC FLUX DENSITY $B_8$ (T) | IRON LOSS $W_{17/50}$ (w/kg) | REMARKS |
|---|---|---|---|---|---|
| 0.03 | 30 | 150 | 1.935 | 0.888 | EXAMPLE COMPARSION EXAMPLE |
| 10 | 30 | 150 | 1.880 | 1.023 | COMPARSION EXAMPLE |

*1: Cooling speed (°C./s) within temperature range 800 to 100° C. in annealing before final cold rolling

EXAMPLE 3

Silicon steel slabs having the chemical compositions shown in Table 3 were heated at 1430° C. for 30 minutes, and then hot rolled into hot rolled steel sheets of a thickness of 2.2 mm. Subsequently, after the hot rolled steel sheets were annealed at 1000° C. for 1 minute, the annealed steel sheets were cold rolled. Specifically, the steel sheets were first cold rolled to a thickness of 1.5 mm while oxides were generated through various thicknesses ranging from 0.1 to 0.3 μm on the respective surfaces of the steel sheets by heating the steel sheets by burners disposed at the entrance and the exit of the rolling mill. Then, the steel sheets were subjected to intermediate annealing at 1100° C. for 2 minutes. The Steel sheets were further cold rolled to a final thickness of 0.23 mm while oxides were generated through thicknesses ranging from 0.1 to 0.3 μm by heating the steel sheets by burners similarly disposed at the entrance and the exit of the cold-rolling mill.

Thereafter, the thus cold rolled steel sheets were subjected to decarburization annealing at 820° C. for 2 minutes, and, after MgO was coated, the resultant steel sheets were subjected to finish annealing at 1200° C. for 5 hours. The magnetic characteristics (magnetic flux density and iron loss) of the thus obtained products measured, the results of this measurement being also shown in Table 3. As is understood from Table 3, the products obtained according to the present invention had remarkably low iron losses.

TABLE 3

| C | Si | Sol. Al | N | Mn | Se | S | Sb | Cu | Sn | Ge | Ni | Mo | $B_8$ (T) | $W_{17/50}$ (w/kg) |
|---|---|---|---|---|---|---|---|---|---|---|---|---|---|---|
| 0.064 | 3.25 | 0.024 | 0.0086 | 0.086 | 0.022 | 0.002 | tr | 0.01 | 0.01 | tr | 0.01 | tr | 1.938 | 0.845 |
| 0.068 | 3.35 | 0.024 | 0.0075 | 0.075 | 0.019 | 0.001 | 0.025 | 0.01 | 0.01 | tr | 0.01 | tr | 1.952 | 0.826 |
| 0.066 | 3.35 | 0.020 | 0.0074 | 0.074 | 0.016 | 0.002 | tr | 0.12 | 0.01 | tr | 0.01 | tr | 1.938 | 0.844 |
| 0.079 | 3.14 | 0.025 | 0.0071 | 0.071 | 0.023 | 0.001 | tr | 0.01 | 0.12 | tr | 0.01 | tr | 1.930 | 0.815 |
| 0.069 | 3.41 | 0.022 | 0.0080 | 0.080 | 0.020 | 0.002 | tr | 0.01 | 0.01 | 0.12 | 0.01 | tr | 1.940 | 0.812 |
| 0.077 | 3.26 | 0.019 | 0.0075 | 0.075 | 0.019 | 0.002 | tr | 0.01 | 0.01 | tr | 0.08 | tr | 1.938 | 0.822 |
| 0.088 | 3.49 | 0.020 | 0.0070 | 0.070 | 0.022 | 0.001 | tr | 0.01 | 0.01 | tr | 0.01 | 0.02 | 1.931 | 0.855 |

EXAMPLE 4

Slabs of a silicon steel containing 3.39% of Si, 0.076% of C, 0.076% of Mn, 0.024% of S, 0.022% of Al, 0.0093% of N, 0.12% of Cu, and 0.029% of Sb, the balance essentially consisting of Fe and impurities, were prepared. The silicon steel slabs were heated at 1430° C. for 30 minutes, and then hot rolled into hot rolled steel sheets of a thickness of 2.2 mm. Subsequently, after the hot rolled steel sheets were annealed at 1000° C. for 1 minute, the annealed steel sheets were cold rolled.

Specifically, the steel sheets were first cold rolled at the various temperatures shown in Table 4 to a thickness of 1.5 mm while cooling oil was supplied only at the entrance of the cold rolling mill and no cooling oil was used at the exit (first cold rolling operation). Then, the steel sheets were subjected to intermediate annealing at 1100° C. for 2 minutes. The steel sheets were further cold rolled to a final thickness of 0.23 mm while cooling oil was supplied in a similar manner (second cold rolling operation). The average thicknesses of oxide layers generated during the above cold rolling are shown in Table 4. Each of these average thicknesses represents an oxide-layer thickness above the corresponding sheet steel surface that had existed before the first and second cold rolling operations took place.

After the cold rolling, the resultant steel sheets were subjected to decarburization annealing at 820° C. for 2 minutes, and, after MgO was coated on, the resultant steel sheets were subjected to finish annealing at 1200° C. for 5 hours. Comparison Examples (shown in Table 4) were produced in exactly the same manner as that described above except that, in the cold rolling step, cooling oil was used at both the entrance and exit of the rolling mill. The results of measuring the magnetic characteristics (magnetic flux density and iron loss) of the products obtained according to the present invention and Comparison Examples are also shown in Table 4. As is understood from Table 4, those products obtained by conducting cold rolling while an oxide layer was generated on the surface of each steel sheet according to the present invention had remarkably low iron losses.

TABLE 4

| COOLING OIL | | OXIDE | COOLING | COLD ROLLING | MAGNETIC FLUX | | |
|---|---|---|---|---|---|---|---|
| ENTRY SIDE | DELIVERY SIDE | LAYER (μm) *1 | SPEED (°C./s) *2 | TEMPERATURE (°C.) | DENSITY $B_8$ (T) | IRON LOSS $W_{17/50}$ (w/kg) | REMARKS |
| APPLIED | NOT APPLIED | 0.22 | 10 | 25 | 1.938 | 0.842 | EXAMPLE OF INVENTION |
| APPLIED | NOT APPLIED | 0.24 | 30 | 25 | 1.937 | 0.829 | EXAMPLE OF INVENTION |

TABLE 4-continued

| COOLING OIL ENTRY SIDE | COOLING OIL DELIVERY SIDE | OXIDE LAYER (μm) *1 | COOLING SPEED (°C./s) *2 | COLD ROLLING TEMPERATURE (°C.) | MAGNETIC FLUX DENSITY $B_8$ (T) | IRON LOSS $W_{17/50}$ (w/kg) | REMARKS |
|---|---|---|---|---|---|---|---|
| APPLIED | NOT APPLIED | 0.20 | 10 | 150 | 1.945 | 0.809 | EXAMPLE OF INVENTION |
| APPLIED | NOT APPLIED | 0.23 | 30 | 150 | 1.944 | 0.808 | EXAMPLE OF INVENTION |
| APPLIED | NOT APPLIED | 0.25 | 30 | 150 | 1.939 | 0.815 | EXAMPLE OF INVENTION |
| APPLIED | APPLIED | 0.01 | 30 | 25 | 1.938 | 0.948 | COMPARISON EXAMPLE |
| APPLIED | APPLIED | 0.01 | 30 | 150 | 1.939 | 0.887 | COMPARISON EXAMPLE |

*1 OXIDE LAYER THICKNESS (μm) GENERATED DURING COLD ROLLING
*2 COOLING SPEED (°C./s) WITHIN TEMPERATURE RANGE 800 TO 100° C.

EXAMPLE 5

Slabs of a silicon steel containing 3.19% of Si, 0.042% of C, 0.074% of Mn, 0.019% of Se, and 0.027% of Sb, the balance essentially consisting of Fe and impurities, were prepared. Each of the silicon steel slabs were heated at 1430° C. for 30 minutes, and then hot rolled into hot rolled steel sheets of a thickness of 2.0 mm.

After the hot rolled steel sheets were annealed at 1000° C. for 1 minute, the steel sheets were subjected to pickling under various conditions so as to cause oxides to remain through the various thicknesses shown in Table 5 on the corresponding surfaces. Then, the steel sheets were cold rolled to a final thickness of 0.20 mm.

Thereafter, the thus Cold rolled steel sheets were subjected to decarburization annealing at 820° C. for 2 minutes, and, after MgO was coated, the resultant steel sheets were subjected to finish annealing at 1200° C. for 5 hours. The magnetic characteristics (magnetic flux density and iron loss) of the thus obtained products measured, the results of this measurement being also shown in Table 5. As will be understood from Table 6, products obtained according to the present invention had remarkably low iron losses.

TABLE 5

| OXIDE LAYER THICKNESS (AVERAGE μm) OUTER LAYER | INNER LAYER | MAGNETIC FLUX DENSITY $B_8$ (T) | IRON LOSS $W_{17/50}$ (w/kg) | REMARKS |
|---|---|---|---|---|
| 0 | 0.2 | 1.906 | 0.806 | EXAMPLE OF THE INVENTION |
| 0 | 0.6 | 1.909 | 0.788 | EXAMPLE OF THE INVENTION |
| 0 | 2.0 | 1.910 | 0.779 | EXAMPLE OF THE INVENTION |
| 0 | 5.0 | 1.909 | 0.801 | EXAMPLE OF THE INVENTION |
| 0 | 0.03 | 1.905 | 0.900 | COMPARISON EXAMPLE |
| 0 | 10.0 | 1.879 | 0.910 | COMPARISON EXAMPLE |
| 2.0 | 5.0 | 1.888 | 0.913 | COMPARISON EXAMPLE |
| 10.0 | 5.0 | 1.877 | 0.924 | COMPARISON EXAMPLE |

EXAMPLE 6

Slabs of a silicon steel containing 3.29% of Si, 0.081% of C, 0.077% of Mn, 0.020% of Se, 0.022% of Al, 0.0091% of N, 0.18% of Cu, and 0.026% of Sb, the balance essentially consisting of Fe and impurities, were prepared. Each of the silicon steel slabs were heated at 1430° C. for 30 minutes, and then hot rolled into hot rolled steel sheets of a thickness of 2.2 mm.

After the hot rolled steel sheets were annealed at 1000° C. for 1 minute, the steel sheets were first cold rolled to a thickness of 1.5 mm. Then, the steel sheets were subjected to intermediate annealing at 1100° C. for 1 minute. The resultant steel sheets were subjected to surface cutting with an elastic grindstone so as to cause oxides to remain through the various thicknesses shown in Table 6 on the corresponding surfaces. Then, the steel sheets were further cold rolled to a final thickness of 0.20 mm.

Thereafter, the thus cold rolled steel sheets were subjected to decarburization annealing at 820° C. for 2 minutes, and, after MgO was coated on, the resultant steel sheets were subjected to finish annealing at 1200° C. for 5 hours. The magnetic characteristics (magnetic flux density and iron loss) of the thus obtained products measured, the results of this measurement being also shown in Table 6. As will be understood from Table 6, products obtained according to the present invention had remarkably low iron losses.

TABLE 6

| OXIDE LAYER THICKNESS (AVERAGE μm) OUTER LAYER | INNER LAYER | MAGNETIC FLUX DENSITY $B_8$ (T) | IRON LOSS $W_{17/50}$ (w/kg) | REMARKS |
|---|---|---|---|---|
| 0 | 0.2 | 1.945 | 0.818 | EXAMPLE OF THE INVENTION |
| 0 | 0.7 | 1.948 | 0.806 | EXAMPLE OF THE INVENTION |
| 0 | 3.0 | 1.945 | 0.800 | EXAMPLE OF THE INVENTION |
| 0 | 0.03 | 1.934 | 0.918 | COMPARISON EXAMPLE |
| 0 | 10.0 | 1.915 | 0.978 | COMPARISON EXAMPLE |
| 1.0 | 5.0 | 1.916 | 0.968 | COMPARISON EXAMPLE |
| 10.0 | 5.0 | 1.908 | 1.011 | COMPARISON EXAMPLE |

EXAMPLE 7

Silicon steel slabs having the chemical compositions shown in Table 7 were heated at 1430° C. for 30 minutes, and then hot rolled into hot rolled steel sheets of a thickness of 2.2 mm. Subsequently, after the hot rolled steel sheets were annealed at 1000° C. for 1 minute, the annealed steel sheets were cold rolled. Specifically, the steel sheets were first cold rolled to a thickness of 1.5 mm. Then, the steel sheets were subjected to intermediate annealing at 1100° C. for 2 minutes. The steel sheets were then pickled to completely remove outer oxide layer and having $SiO_2$-based inner oxide layer of 1.0 μm remaining and the steel sheets were further cold rolled to a final thickness of 0.23 mm.

Thereafter, the thus cold rolled steel sheets were subjected to decarburization annealing at 820° C. for 2 minutes, and, after MgO was coated, the resultant steel sheets were subjected to finish annealing at 1200° C. for 5 hours. The magnetic characteristics (magnetic flux density and iron loss) of the thus obtained products measured, the results of this measurement being also shown in Table 7. As is understood from Table 7, the products obtained according to the present invention had remarkably low iron losses.

TABLE 7

| C | Si | Sol. Al | N | Mn | Se | S | Cu | Sn | Ge | Ni | Mo | P | V | $B_8$ (T) | $W_{17/50}$ (w/kg) |
|---|---|---|---|---|---|---|---|---|---|---|---|---|---|---|---|
| 0.071 | 3.20 | 0.025 | 0.0088 | 0.071 | 0.017 | 0.002 | 0.01 | 0.01 | tr | 0.01 | tr | 0.01 | 0.01 | 1.940 | 0.815 |
| 0.069 | 3.11 | 0.023 | 0.0091 | 0.063 | 0.019 | 0.001 | 0.09 | 0.01 | tr | 0.01 | tr | 0.01 | 0.01 | 1.943 | 0.810 |
| 0.070 | 3.41 | 0.022 | 0.0090 | 0.071 | 0.018 | 0.001 | 0.01 | 0.18 | tr | 0.01 | tr | 0.01 | 0.01 | 1.930 | 0.795 |
| 0.069 | 3.25 | 0.023 | 0.0086 | 0.069 | 0.025 | 0.002 | 0.01 | 0.01 | 0.05 | 0.01 | tr | 0.01 | 0.01 | 1.937 | 0.800 |
| 0.080 | 3.30 | 0.019 | 0.0097 | 0.066 | 0.016 | 0.002 | 0.01 | 0.01 | tr | 0.12 | tr | 0.01 | 0.01 | 1.945 | 0.810 |
| 0.071 | 3.16 | 0.022 | 0.0080 | 0.077 | 0.019 | 0.001 | 0.01 | 0.01 | tr | 0.01 | 0.03 | 0.01 | 0.01 | 1.941 | 0.819 |
| 0.077 | 3.33 | 0.025 | 0.0085 | 0.069 | 0.020 | 0.001 | 0.01 | 0.01 | tr | 0.01 | tr | 0.05 | 0.01 | 1.950 | 0.808 |
| 0.070 | 3.15 | 0.030 | 0.0076 | 0.070 | 0.026 | 0.002 | 0.01 | 0.01 | tr | 0.01 | tr | 0.01 | 0.08 | 1.940 | 0.805 |

ADVANTAGES OF THE INVENTION

According to this invention, grain oriented silicon steel sheets having extremely low iron loss can be produced on an industrial scale and stably supply products having superior properties.

What is claimed is:

1. A method of producing a grain oriented silicon steel sheet having a low iron loss, comprising the steps of:

hot rolling a silicon steel slab containing 2.0 to 4.0% by weight of Si, and an inhibitor-forming component of at least one element selected from the group consisting of S and Se, thereby obtaining a hot rolled steel sheet having an oxide layer on its surface;

cold rolling said hot rolled steel sheet having said oxide layer into a cold rolled steel sheet having a final thickness, said cold rolling comprising either cold rolling performed one time or cold rolling performed a plurality of times with intermediate annealing intervening therebetween;

decarburizing said cold rolled steel sheet; and after coating the surface of the decarburized cold rolled steel sheet with an annealing separation agent mainly comprising MgO, subjecting the cold rolled steel sheet to secondary recrystallization annealing and then purification annealing.

2. The method defined in claim 1 wherein an outer portion of said oxide layer on the surface of the steel sheet after said hot rolling or said intervening intermediate annealing is removed, thereby maintaining an inner oxide layer of a thickness of about 0.05 to 5 μm on the surface of the steel sheet, the steel sheet then being subjected to cold rolling.

3. A method according to claim 1 further comprising annealing said hot rolled steel sheet and, in said annealing before a final cold rolling step in said cold rolling, the cooling speed is not less than about 20° C./sec within a temperature range from about 800° to 100° C.

4. In a method of producing a cold rolled grain oriented silicon steel sheet from a steel sheet containing about 1.0–4.0 wt % of Si and about 0.010–040 wt % of an inhibitor selected from the group consisting of S and Se, the steps which comprise generating an oxide layer having a thickness of about 0.05–5 μm, and cold rolling said sheet to final thickness in the presence of said oxide layer.

5. The method defined in claim 4 wherein said oxide layer is generated by heating the strip during cold rolling.

6. The method defined in claim 5 wherein said heating is caused by limiting the use of cooling oil to such an extent that some of the oil burns on the surface of the steel sheet.

7. The method defined in claim 6 wherein said cold rolling is conducted in several successive passes each having an entrance and an exit, and wherein said cooling oil is applied to the sheet at the entrances only and not at the exits of said passes.

8. The method defined in claim 1 further comprising annealing said hot rolled steel sheet prior to cold rolling.

9. The method defined in claim 1 wherein said oxide layer is formed by removing a portion of a layer formed during hot rolling.

10. A method of producing a grain oriented silicon steel sheet having a low iron loss, comprising the steps of:

hot rolling a silicon steel slab containing 2.0 to 4.0% by weight of Si, and an inhibitor-forming component of at least one element selected from the group consisting of S and Se, thereby obtaining a hot rolled steel sheet having an oxide layer on its surface, said oxide layer having a thickness of about 0.5–5.0 μm;

cold rolling said hot rolled steel sheet having said oxide layer into a cold rolled steel sheet having a final thickness, said cold rolling comprising either cold rolling performed one time or cold rolling performed a plurality of times with intermediate annealing intervening therebetween;

decarburizing said cold rolled steel sheet; and after coating the surface of the decarburized cold rolled steel sheet with an annealing separation agent mainly comprising MgO, subjecting the cold rolled steel sheet to secondary recrystallization annealing and then purification annealing.

11. The method defined in claim 10 wherein an outer portion of said oxide layer on the surface of the steel sheet after said hot rolling or said immediate annealing is removed, thereby maintaining an inner oxide layer of a thickness of about 0.05 to 5 μm on the surface of the steel sheet, the steel sheet then being subjected to cold rolling.

12. A method according to any of claims 10 and 11, wherein said cold rolling is effected within a temperature range from about 100° to 350° C.

13. In a method of producing a cold rolled grain oriented silicon steel sheet from a steel sheet containing about 2.0–4.0 wt % of Si and an inhibitor selected from the group consisting of S and Se, the steps which comprise generating an oxide layer having a thickness of about 0.05–5 μm, and cold rolling said sheet to final thickness in the presence of said oxide layer.

14. The method defined in claim 13 wherein said cold rolling is effected with a rolling mill while rolling oil is supplied only at the entrance of said rolling mill, and an oxide layer is generated on the surface of the steel sheet.

15. A method according to any of claims 1, 2 and 14, wherein said cold rolling is effected within a temperature range from about 100° to 350° C.

* * * * *